US010366678B2

(12) United States Patent
Goins et al.

(10) Patent No.: US 10,366,678 B2
(45) Date of Patent: Jul. 30, 2019

(54) PICK FOR USE WITH A STRINGED INSTRUMENT

(76) Inventors: Matthew Goins, Knoxville, TN (US); Allen Goins, Knoxville, TN (US)

( * ) Notice: Subject to any disclaimer, the term of this patent is extended or adjusted under 35 U.S.C. 154(b) by 3493 days.

(21) Appl. No.: 12/061,068

(22) Filed: Apr. 2, 2008

(65) Prior Publication Data

US 2009/0249938 A1 Oct. 8, 2009

(51) Int. Cl.
*G10D 3/16* (2006.01)

(52) U.S. Cl.
CPC ..... *G10D 3/163* (2013.01)

(58) Field of Classification Search
CPC ..... G10D 3/163
USPC ..... 84/320–322
See application file for complete search history.

(56) References Cited

U.S. PATENT DOCUMENTS

2006/0086231 A1* 4/2006 Sielaff ..... 84/322
2007/0148409 A1* 6/2007 Rios et al. ..... 428/167

FOREIGN PATENT DOCUMENTS

JP 2000104083 A * 4/2000

OTHER PUBLICATIONS

American Chemical Society, vol. 49, No. 1, Jan. 1957, p. 23A.*
http://www.boedeker.com/vespel_p.htm—Website for Vespel Polyimide Specifications.
Brochure—Professional Plastics, Inc.
Meldin 7000 Series, MSDS No. SGPPL.BR.001.2006 [Online]; Saint-Gobain Performance Plastics: Bristol, RI, Oct. 30, 2006. https://www.plastics.saint-gobain.com/document-center-classification/sds-safety-data-sheet (accessed Nov. 5, 2018).
Vespel Polyimide, MSDS No. DU003855 [Online]; Du Pont: Wilmington, DE, Jan. 26, 2007. https://www.hypertherm.com/Download?fileId=HYP106710&zip=False (accessed Nov. 5, 2018).

* cited by examiner

*Primary Examiner* — Kimberly R Lockett
(74) *Attorney, Agent, or Firm* — Pitts & Lake, P.C.

(57) ABSTRACT

Described is a pick for use with a stringed instrument, the pick being constructed of a polyimide material. Because of the various physical properties of the polyimide material, the pick exhibits increased dimensional stability, desirable lubricity throughout the pick, increased resistance to wear, and desirable rigidity. The combined properties of the pick provide exceptional tonality and longevity.

19 Claims, 1 Drawing Sheet

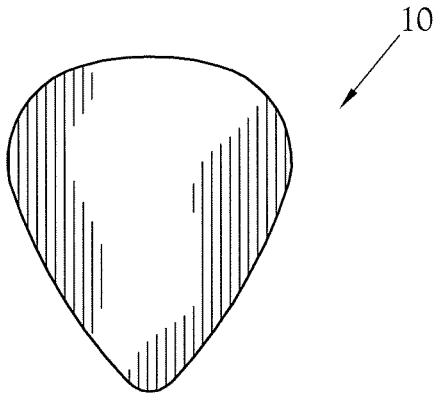
10

PICK FOR USE WITH A STRINGED INSTRUMENT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention pertains to a device for use with a stringed instrument. More particularly, this invention pertains to a pick for strumming, picking, and plucking a stringed instrument.

2. Description of the Related Art

Many stringed instruments, such as guitars, mandolins, and banjos, are played using a pick. More specifically, the pick is used to strum, pick, and pluck the strings of the stringed instrument to generate sound. Conventional picks are constructed of materials such as various plastics, nylon, glass, wood, and tortoise shell. Many of the various plastic picks provide desirable tonality and lubricity by having polished and treated surfaces. However, plastic picks are limited in that they lack dimensional stability and durability. More specifically, plastic picks are prone to warping, chipping, and breaking during use. Additionally, once the polished and treated surface of a plastic pick is worn through, the pick no longer provides the desirable tonality or lubricity. Some plastic picks wear to the extent that they no longer satisfy the using musician within a matter of hours. For example, Danny Roberts, a professional mandolin player, limits his use of any single plastic pick to a single show due to the effects of the wear on the pick. Other conventional picks, such as the mentioned nylon, glass, and wood picks, are limited in that they suffer the limitations of the plastic picks in addition to not providing the desirable tonality preferred by many musicians. Although, the mentioned tortoise shell picks provide the tonality desired by many musicians and, to an extent, the desired durability, tortoise shell picks are becoming increasingly difficult to attain due to lack of supply and increase in cost. The supply and cost concerns relating to the tortoise shell pick are due to many species of the tortoise having the status of being an endangered animal. Consequently, a pick for use with a stringed instrument that provides desirable tonality and is resistant to wear is desired.

BRIEF SUMMARY OF THE INVENTION

In accordance with the various features of the present invention there is provided a pick for use with a stringed instrument, the pick being constructed of a polyimide material. The physical properties of the polyimide material are such that the pick exhibits increased dimensional stability, desirable lubricity throughout the pick, increased resistance to wear, and desirable rigidity. As a result, the pick provides exceptional tonality and longevity.

BRIEF DESCRIPTION OF THE SEVERAL VIEWS OF THE DRAWINGS

The above-mentioned features of the invention will become more clearly understood from the following detailed description of the invention read together with the drawings in which:

FIG. 1 illustrates one embodiment of the pick in accordance with the various features of the present invention.

DETAILED DESCRIPTION OF THE INVENTION

The present invention provides a pick for use with a stringed instrument, the pick being constructed of a polyimide material. Because of the various physical properties of the polyimide material, the pick exhibits increased dimensional stability, desirable lubricity throughout the pick, increased resistance to wear, and desirable rigidity. The combined properties of the pick provide exceptional tonality and longevity. One embodiment of the pick constructed in accordance with the various features of the present invention is illustrated generally at 10 in FIG. 1.

In the illustrated embodiment, the pick 10 is a flat pick constructed of the polyimide material. The polyimide material is formed from resin and is characterized by a ring-shaped molecular structure containing nitrogen. In some embodiments, the polyimide material comprises a ring-shaped molecular structure such as poly-oxydiphenylene-pyromellitimide. The polyimide material is manufactured and traded under various trademarks such as Vespel®, Meldin®, and Plavis®. Accordingly, in one embodiment, the polyimide material is the material known as Vespel®, which is manufactured by E.I. du Pont de Nemours and Company. Properties of Vespel® include a density of 1.43 g/cm$^3$, water absorption over a 24 hour period at 73° F. of 0.24%, a tensile strength at 73° F. of 12,500 psi, a tensile elongation at 73° F. of 7.5%, a flexural strength at 73° F. of 16,000 psi, a flexural modulus at 73° F. of 450,000 psi, a compressive strength (10% strain) at 73° F. of 19,300 psi, a compressive modulus at 73° F. of 350,000 psi, a hardness of E45-60 on the Rockwell scale, an IZOD notched impact of 0.8 ft-lb/in, a coefficient of linear thermal expansion of $3.0*10^{-5}$ in/in/° F., a heat deflection temperature at 264 psi of 680° F., a maximum continuous operating temperature of 500° F., a thermal conductivity of 2.0 BTU-in/ft$^2$-hr-° F., a flammability rating of V-0, a dielectric strength at ⅛ inch of 560 V/mil, a dielectric constant at 1 MHz of 3.55, a dissipation factor at 1 MHz of 0.0034, and a volume resistivity at 50% RH of $10^{14}$-$10^{15}$ ohm-cm. It should be noted that the polyimide material can be a material other than the material known as Vespel® without departing from the scope or spirit of the present invention. It should also be noted that all embodiments of the polyimide material have properties similar to those discussed above relating to Vespel®.

The pick 10 includes the combined properties of increased dimensional stability, desirable lubricity throughout the pick 10, increased resistance to wear, and desirable rigidity. Having increased dimensional stability means that the pick 10 does not expand or contract under conditions associated with typical use. Stated differently, the pick 10 does not warp, chip, or break under conditions associated with typical use of the pick 10. Consequently, the shape of the pick 10, and more importantly, the shape of the edge used for plucking and strumming the strings, maintains its designed shape and does not vary such that the pick 10 provides a consistent tonality. Having desirable lubricity throughout the pick 10 means that the polyimide material includes a low coefficient of friction and an inherent physical smoothness that permits the pick 10 to deliver a desirable tonality and to move among the strings without sticking to the strings. Additionally, it means that the low coefficient of friction and smoothness is a characteristic that is present throughout the pick 10, not just at the surface. The pick 10 is resistant to wear because it includes the combined characteristics of increased dimensional stability and desirable lubricity throughout the pick 10. More specifically, the pick 10 is resistant to wear because it maintains its designed shape during use and, although the initial outer surface is worn due to use, the underlying material includes the desired lubricity for optimal tonality and playability. Stated differently, the pick 10 has life beyond the initial outer surface. Desirable rigidity of the pick 10 is the rigidity, combined with the desirable lubricity, that provides desirable tonality and playability. Considering the above discussion, it can be seen that the combined properties of the polyimide material provide a pick 10 having exceptional tonality and longevity.

In one embodiment, the pick 10 has a thickness or gauge of 0.05 in. In other embodiments, the pick 10 has respective thicknesses or gauges inclusively ranging from 0.01 to 0.2 in. Although the pick 10 of FIG. 1 is a flat pick, it should be noted that the pick 10 can be other picks for use with a stringed instrument, such as finger picks and thumb picks, without departing from the scope or spirit of the present invention. It should also be noted that the pick 10 can be constructed of a pure polyimide material or a polyimide material combined with a filler material. For example, the pick 10 can be constructed of 85% polyimide and 15% graphite, or 60% polyimide and 40% graphite, or 65% polyimide, 10% polytetrafluoroethylene (PTFE), and 15% graphite, or 85% polyimide and 15% molybdenum disulfide.

From the foregoing description, those skilled in the art will recognize that a pick for use with a stringed instrument offering advantages over the prior art has been provided. The pick is constructed of a polyimide material. Because of the various physical properties of the polyimide material, the pick includes the properties of increased dimensional stability, desirable lubricity throughout the pick, increased resistance to wear, and desirable rigidity. The combined properties of the pick provide exceptional tonality and longevity.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. A pick for use with a stringed instrument, said pick being constructed of a material comprising:

a polyimide material characterized by a ring-shaped molecular structure containing nitrogen, and additionally comprising graphite.

2. The pick of claim 1 wherein said polyimide material is formed from resin.

3. The pick of claim 1 wherein said polyimide material includes poly-oxydiphenylene-pyromellitimide.

4. The pick of claim 1 wherein said pick is constructed of a material additionally comprising polytetrafluoroethylene.

5. The pick of claim 1 wherein said pick is constructed of a material additionally comprising molybdenum disulfide.

6. The pick of claim 1 wherein said pick has a gauge within the inclusive range of 0.01 in to 0.2 in.

7. The pick of claim 1 wherein said pick has a gauge of 0.05 in.

8. The pick of claim 1 wherein said pick is a flat pick.

9. The pick of claim 1 wherein said pick is a finger pick.

10. The pick of claim 1 wherein said pick is a thumb pick.

11. A pick for use with a stringed instrument, said pick being constructed of a material comprising:

a polyimide material characterized by a ring-shaped molecular structure containing nitrogen, and additionally comprising molybdenum disulfide.

12. The pick of claim 11 wherein said polyimide material is formed from resin.

13. The pick of claim 11 wherein said polyimide material includes poly-oxydiphenylene-pyromellitimide.

14. The pick of claim 11 wherein said pick is constructed of a material additionally comprising graphite.

15. The pick of claim 11 wherein said pick is constructed of a material additionally comprising polytetrafluoroethylene.

16. The pick of claim 11 wherein said pick has a gauge within the inclusive range of 0.01 in to 0.2 in.

17. The pick of claim 11 wherein said pick has a gauge of 0.05 in.

18. The pick of claim 11 wherein said pick is a flat pick.

19. The pick of claim 11 wherein said pick is a finger pick.

* * * * *